United States Patent [19]

Chapa

[11] 4,165,737

[45] Aug. 28, 1979

[54] FOOT MASSAGING DEVICE

[76] Inventor: Arturo Chapa, 7302 Stewart Rd., Galveston, Tex. 77551

[21] Appl. No.: 878,515

[22] Filed: Feb. 17, 1978

[51] Int. Cl.[2] ..... A61H 29/00

[52] U.S. Cl. ..... 128/24.3; 128/25 B; 128/58; 128/65

[58] Field of Search ..... 128/24.3, 58, 25 B, 128/57, 65

[56] References Cited

U.S. PATENT DOCUMENTS

| | | | |
|---|---|---|---|
| 3,128,761 | 4/1964 | Smith | 128/58 |
| 3,837,334 | 9/1974 | Johnson | 128/25 B |

*Primary Examiner*—Lawrence W. Trapp
*Attorney, Agent, or Firm*—Daniel Jay Tick

[57] ABSTRACT

A plurality of hard rubber rod-like massage members are moved by an electric motor in a plane in a predetermined direction at the open top of a box so that a foot resting thereon is massaged. Steam is directed at the bottom of a foot resting on the massage members.

2 Claims, 3 Drawing Figures

FOOT MASSAGING DEVICE

BACKGROUND OF THE INVENTION

The present invention relates to a foot massaging device.

Foot massagers are disclosed in the following U.S. patents. U.S. Pat. No. 3,742,941, issued to Aizenstat on July 3, 1973, U.S. Pat. No. 3,762,402, issued to Abramovitz on Oct. 2, 1973, U.S. Pat. No. 3,768,461, issued to Taylor on Oct. 30, 1973, U.S. Pat. No. 3,789,836, issued to Girten on Feb. 5, 1974, U.S. Pat. No. 3,830,232, issued to McNair on Aug. 20, 1974 and U.S. Pat. No. 3,942,520, issued to McNair on Mar. 9, 1976.

Objects of the invention are to provide a foot massaging device of simple structure, which is inexpensive in manufacture, used with facility, convenience and safety and functions efficiently, effectively and reliably to massage the feet of a user and thereby provide all the subsequent benefits of a proper foot massage.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
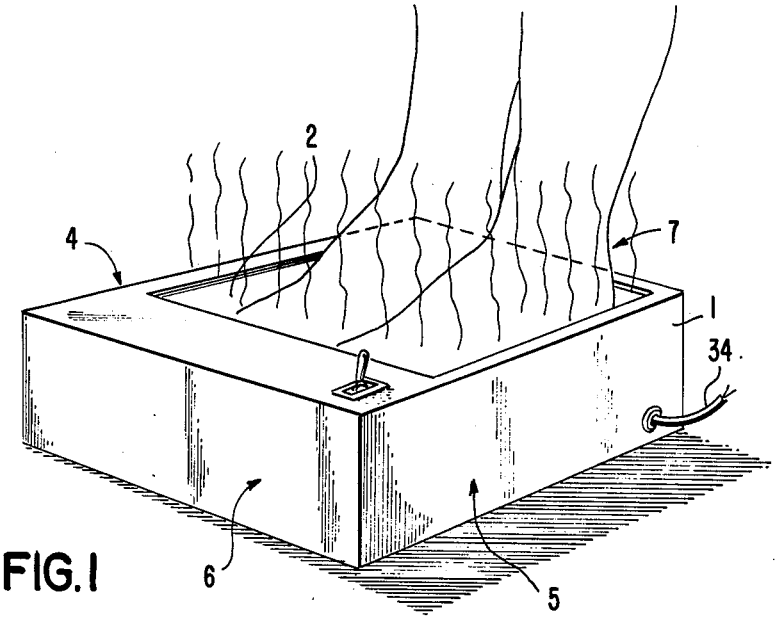
FIG. 1 is a view of an embodiment of the foot massaging device of the invention.
Figure 3:
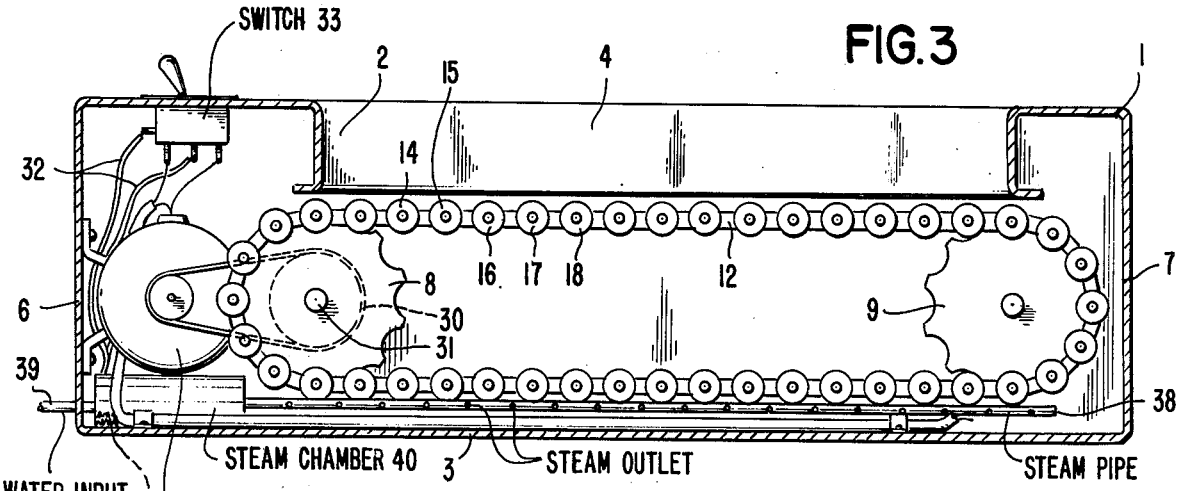
FIG. 3 is a sectional view, on an enlarged scale, taken along the lines III—III, of FIG. 2.
Figure 2:
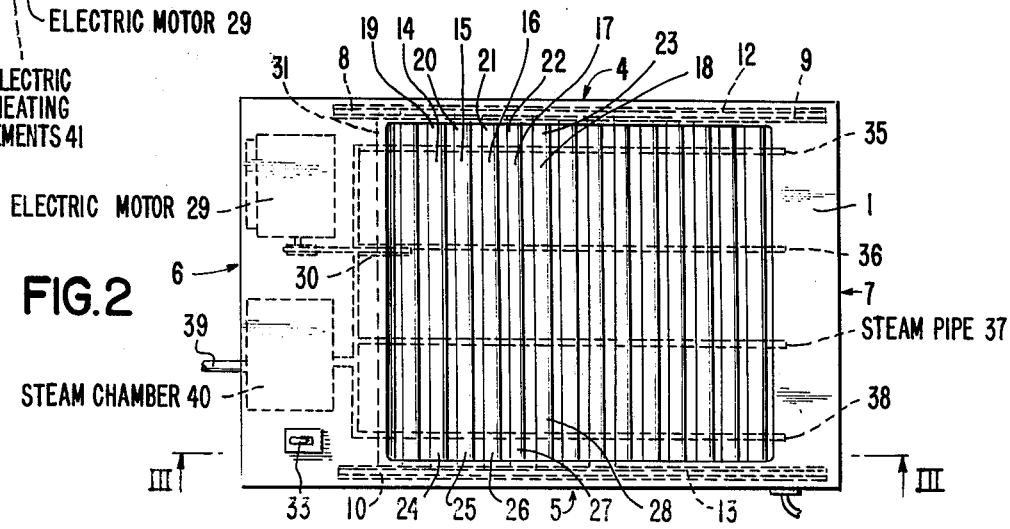
FIG. 2 is a top plan view, on an enlarged scale, of the embodiment of FIG. 1.

The foot massaging device of the invention comprises a box 1 having a partially open top 2 (FIGS. 1 and 2), a bottom 3 (FIG. 3), a first pair of parallel sides 4 and 5, and a second pair of parallel sides 6 and 7 (FIGS. 1 to 3).

A plurality of sprocket wheels 8, 9, 10 and 11 (FIG. 2) are rotatably mounted in the box 1 parallel to the first pair of sides 4 and 5. First and second ones 8 and 9 of the sprocket wheels are rotatably mounted in the box 1 adjacent the side 4, as shown in FIGS. 2 and 3. Third and fourth ones 10 and 11 of the sprocket wheels are rotatably mounted in the box 1 adjacent the side 5, as shown in FIG. 2.

A first endless sprocket chain 12 is mounted in the first and second sprocket wheels 8 and 9 and extends therebetween, as shown in FIGS. 2 and 3.

A second endless sprocket chain 13 is mounted on the third and fourth sprocket wheels 10 and 11 and extends therebetween, as shown in FIG. 2.

A plurality of hard rubber rod-like massage members 14, 15, 16, 17, 18, and so on, are provided, as shown in FIGS. 2 and 3. Each of the massage members 14 to 18, and so on, has spaced opposite first and second ends 19, 20, 21, 22, 23, and so on, and 24, 25, 26, 27, 28, and so on, respectively.

The first end 19 to 23, and so on, of each massage member 14 to 18, and so on, is affixed to the first chain 12, as shown in FIG. 2. The second end 24 to 28, and so on, of each massage member 14 to 18, and so on, is affixed to the second chain 13, as shown in FIG. 2. The massage members 14 to 18, and so on, are positioned parallel to the second pair of sides 6 and 7 of the box 1 and extend between the first and second sprocket chains 12 and 13, as shown in FIGS. 2 and 3.

An electric motor 29 is mounted in the box 1 and coupled to the sprocket wheels 8 and 10 via an intermediate gear 30 mounted on a shaft 31 (FIGS. 2 and 3). The sprocket wheels 8 and 10 are affixed to the spaced opposite ends of the shaft 31 and are rotatable therewith, whereas the intermediate gear 30 is affixed to said shaft at an intermediate point thereof and is rotatable with said shaft.

When the motor 29 is energized, it rotates the sprocket wheels 8 to 11 thereby rotating the sprocket chains 12 and 13 and causing the massage members 14 to 18, and so on, to move in a plane in a predetermined direction at the open top 4 of the box 1 so that a foot or feet resting on the massage members is or are massaged in a proper manner. The user applies as much pressure as he or she desired in order to attain comfort and then energizes the electric motor 29 via a circuit which includes electrical conductors 32 (FIG. 3) and a switch 33 (FIGS. 2 and 3) for electrically connecting the motor to a source of electrical energy under the control of the switch. Although the source of electrical energy is not shown in the FIGS., it may comprise any suitable source of electrical energy such as, for example, a commercial power source. The electrical energy is supplied via electrical conductors 34 (FIG. 1).

In accordance with the invention, perforated steam pipes 35, 36, 37 and 38 are provided at the bottom 3 of the box 1, as shown in FIG. 2. The perforated steam pipes 35 to 38 are coupled to a source of steam via a coupling connection 39 which may include a steam chamber 40 for storing some of the steam. The steam is directed at the bottom of a foot or feet resting on the massage members 14 to 18, and so on, and thereby soothes the feet being massaged further with heat and moisture. The steam may be generated in the box 1 by supplying water to the steam chamber 40 via the coupling 39 and heating said water to steam via electric heating elements 41 positioned in operative proximity with said steam chamber, as shown in FIG. 3.

While the invention has been described by means of a specific example and in a specfic embodiment, I do not wish to be limited thereto, for obvious modifications will occur to those skilled in the art without departing from the spirit and scope of the invention.

I claim:

1. A foot massaging device, comprising a box having a partially open top, a bottom, a first pair of parallel sides and a second pair of parallel sides;

a plurality of sprocket wheels rotatably mounted in the box parallel to the first pair of sides, first and second ones of the sprocket wheels being adjacent one of the first pair of sides and third and fourth ones of the sprocket wheels being adjacent the other of the first pair of sides;

a first endless sprocket chain mounted on the first and second sprocket wheels and extending therebetween;

a second endless sprocket chain mounted on the third and fourth sprocket wheels and extending therebetween;

a plurality of hard rubber rod-like massage members each having spaced opposite first and second ends, the first end of each massage member being affixed to the first chain, the second end of each massage member being affixed to the second chain, said massage members being positioned parallel to the second pair of sides of the box and extending between the chains;

an electric motor mounted in the box and coupled to a pair of sprocket wheels in a manner whereby when the motor is energized it rotates the sprocket wheels thereby rotating the sprocket chains and causing the massage members to move in a plane in a predetermined direction at the open top of the box so that a foot resting thereon is massaged; and circuit means including electrical conductors and a switch for electrically connecting the motor to a source of electrical energy under the control of the switch.

2. A foot massaging device as claimed in claim 1, further comprising perforated steam pipes at the bottom of the box and coupling means for coupling the steam pipes to a source of steam whereby steam is directed at the bottom of a foot resting on the massage members.

* * * * *